United States Patent [19]

Taricco

[11] 4,208,174

[45] Jun. 17, 1980

[54] RADIAL COMPRESSION MOLDING APPARATUS

[75] Inventor: Stefano Taricco, Turin, Italy

[73] Assignee: Centro Ricerche Fiat S.p.A., Orbassano, Italy

[21] Appl. No.: 8,441

[22] Filed: Feb. 1, 1979

[30] Foreign Application Priority Data

Feb. 1, 1978 [IT] Italy ..... 67192 A/78

[51] Int. Cl.[2] ..... B30B 11/00; B30B 1/08

[52] U.S. Cl. ..... 425/78; 425/330

[58] Field of Search ..... 425/77, 78, 79, 330, 425/DIG. 5, DIG. 26

[56] References Cited

U.S. PATENT DOCUMENTS

| | | | |
|---|---|---|---|
| 2,844,845 | 7/1958 | Krall | 425/79 |
| 3,271,502 | 9/1966 | Wentorf | 425/330 X |
| 3,319,290 | 5/1967 | Clark | 425/330 |
| 3,384,926 | 5/1968 | Tsujii | 425/77 |
| 3,555,607 | 1/1971 | Epain et al. | 425/77 |

*Primary Examiner*—J. Howard Flint, Jr.

*Attorney, Agent, or Firm*—Sughrue, Rothwell, Mion, Zinn & Macpeak

[57] ABSTRACT

The radial compression molding apparatus according to the invention is provided with a plurality of complementary die segments which define a cavity in which moldable material is to be introduced. The die segments are movable concurrently between a first inoperative position and a final compression position so as to be adapted to compress the moldable material within the cavity from a first volume to a final volume along a plurality of radial directions which are substantially perpendicular to a common longitudinal axis. Each die segment consists of a plurality of separately operable segment portions which are superimposed in a direction parallel to said common longitudinal axis so as to permit to obtain molded articles consisting of a plurality of contiguous longitudinal portions having different cross sections and equal density.

2 Claims, 5 Drawing Figures

RADIAL COMPRESSION MOLDING APPARATUS

Figure 1:
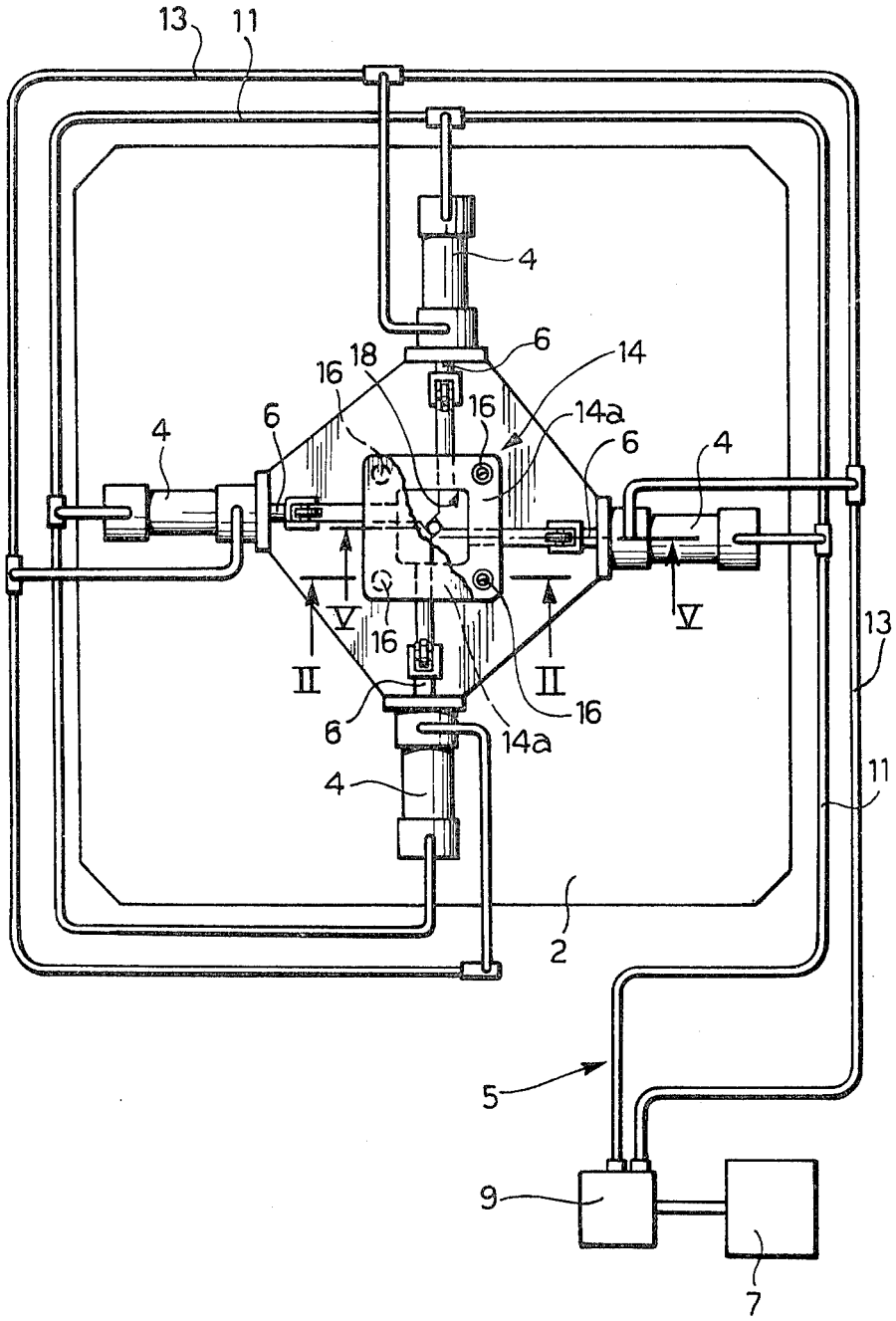

The present invention relates to a radial compression die for forming a molded article by compressing a moldable material from a first volume to a final volume along a plurality of radial directions which are substantially perpendicular to a common longitudinal axis and lie in different planes, said radial compression die comprising a plurality of complementary die segments which define a cavity in which said moldable material is to be introduced and are movable concurrently between a first inoperative position and a final compression position which respectively define said first volume end said final volume, and drive means to forcedly move said die segments between their first and final positions.

Various radial molding apparatus for use in the manufacture of molded articles from discrete particles such as powdered metals and powdered plastics have been proposed in order to obtain articles having a constant density along their longitudinal dimension. German Pat. No. 57923 (FLINT), German patent application Nos. 2520329 (STEFFENS), 1284847 (SCHOENENBERGER), 1074477 (LAEIS-WERKE) and 2446959 (RIBBACK), French patent application Nos. 2143411 (ALUMINIUM SUISSE) and 2223152 (EURATOM), French application Nos. 1.178.560 (HORN), and 763.205 (MAATSCHAPPIJ TOT EXPLOITATIE VAN "TEN BOSCH OCTROOIEN N.V.") and U.S. Pat. No. 3,319,290 (CLARK) are all related to radial compression molding apparatus of the above-cited type. However the devices of the Prior Art permitt to obtain molded articles having constant density along their longitudinal dimension only when the articles to be molded have a substantially constant cross-section along said dimension.

If, for example, the article to be molded consists of a plurality of contiguous longitudinal portions having different cross sections, to simply utilize a plurality of die segments that, in their final compression position, define a final volume having a shape equal to the shape of the article to be molded will result in molded articles in which said contiguous longitudinal portions have different density.

It is the object of the invention to provide a radial compression molding apparatus which permitts to obtain molded articles having constant density along their longitudinal dimension also in case said articles consist of a plurality of contiguous longitudinal portions having different cross-sections.

This object is achieved according to the invention by providing a radial compression die for forming a molded article by compressing a moldable material from a first volume to a final volume along a plurality of radial directions which are substantially perpendicular to a common longitudinal axis and lie in different planes, said radial compression die comprising a plurality of complementary die segments which define a cavity in which said moldable material is to be introduced and are movable concurrently between a first inoperative position and a final compression position which respectively define said first volume and said final volume, and drive means to forcedly move said die segments between their first and final positions each of said die segments consisting of a plurality of separate adjacent segment portions which are superimposed along a direction parallel to said common longitudinal axis and are simultaneously operable by said drive means in such a way as to undergo displacements having different lengths when said die segments are moved between their first and final positions.

In the radial compression die according to the present invention, the die segments are adapted to define, when they are in their first inoperative position, a first volume having a shape which is geometrically similar to the shape of the final volume of the molded article. This ensures that all the above cited contiguous longitudinal portions of the molded article have equal density. As a matter of fact the density of a molded article having a constant cross-section is equal to the ratio between the weight of the moldable material utilized in the radial compression process and the final volume of the molded article. Therefore the density of a molded article having a constant cross-section depends on the ratio between the first volume defined by the die segments in their first inoperative position and the final volume of the molded article. This explains the reason of the above-mentioned condition of geometrical similarity.

In the radial compression die according to the present invention, the segment portions of each die segment are respectively utilized in order to accomplish the molding of the contiguous longitudinal portions of the article. The displacements of the segment portions corresponding to the movement of the die segments between their first inoperative position and their final compression position are determined so as to comply with the above-cited condition of geometrical similarity between said first volume and said final volume.

Figure 2:
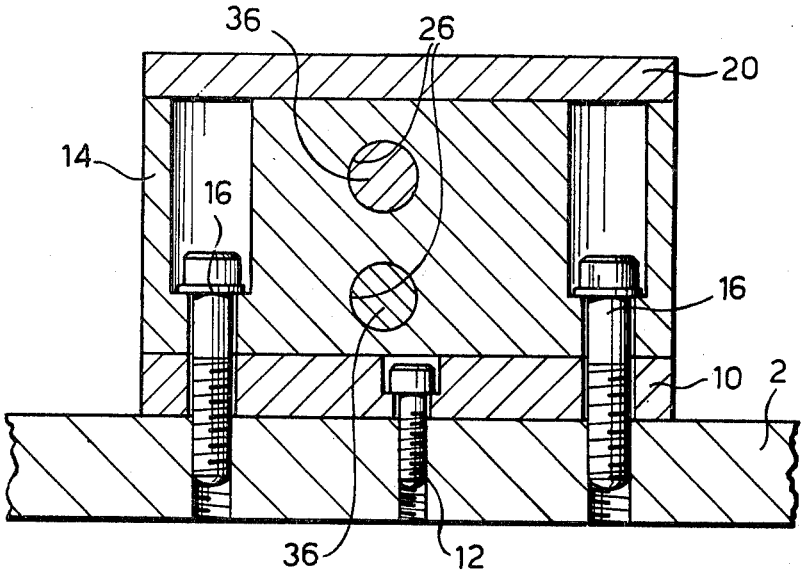
Figure 3:
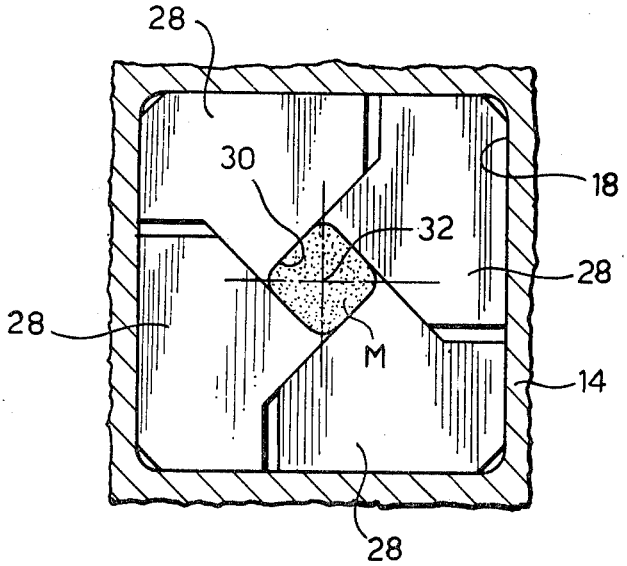
Figure 4:
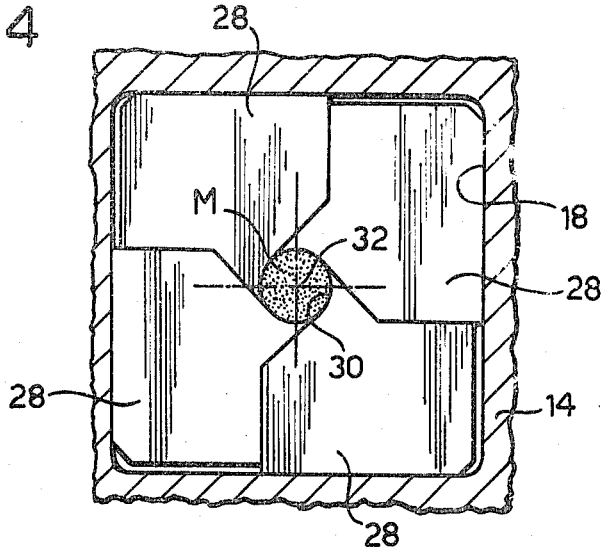
Figure 5:
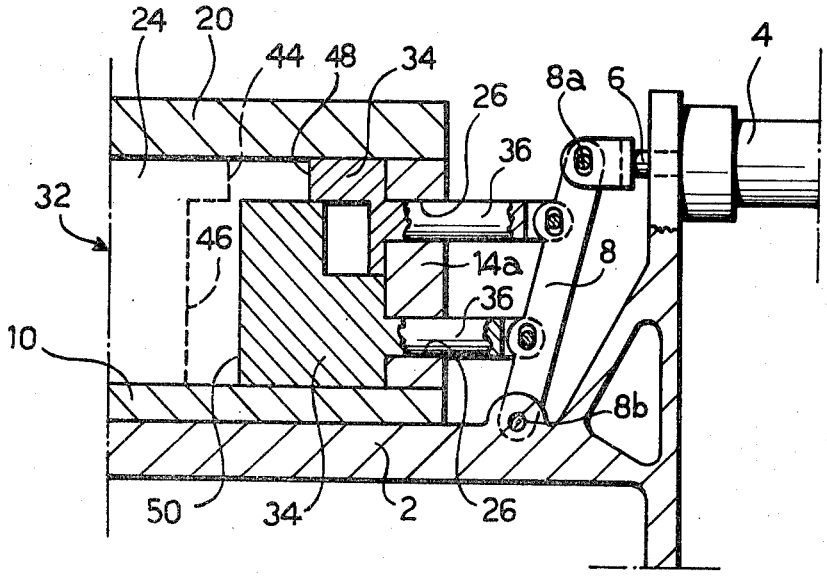

These and other features and advantages of the present invention with be apparent from the following more particular description of the preferred embodiment of the invention, with reference to the accompanying drawings, in which:

FIG. 1 is a plan view of a radial compression molding apparatus according to the present invention, FIG. 2 is a partial sectional view taken on the line II—II of FIG. 1, FIG. 3 is a plan view in an enlarged scale of a detail of FIG. 1, showing the die segments in their first inoperative position, FIG. 4 is a plan view of the detail of FIG. 3, showing the die segments in their final compression position, and FIG. 5 is a partial sectional view taken on the line V—V of FIG. 1.

The radial compression molding apparatus shown in FIG. 1 is comprised of a support member 2 on which four double-acting hydraulic jacks 4 are mounted. Each hydraulic jack 4 has a piston rod 6 (see FIG. 5) which is connected in 8*a* to one end of a drive lever 8 having its other end pivotally connected to the support member 2 on an axis 8*b*. The four hydraulic jacks 4 are operable by means of a hydraulic circuit 5 which comprises a hydraulic power unit 7 of a known type. The hydraulic power unit 7 is connected via a control unit 9 of a known type to the hydraulic jacks 4 by means of first conduit means 11 and second conduit means 13. The control unit 9 is utilized in a known way to control the movements of the piston rods 6 between their retracted end extended positions.

In FIG. 2 the reference number 10 indicates a lower plate which is fixed to the support member 2 by means of a screw 12. A die segment guide member 14 is mounted onto the lower plate 10 and onto the support member 2 by means of four screws 16. The die segment guide member 14 is in form of a parallelepiped body which is provided with a central hole 18 which has a square cross section. The hole 18 is defined by four lateral walls. 14*a*. An upper plate 20 is mounted onto the guide member 14 by means of screws not shown in the drawings. The lower plate 10, the upper plate 20 and the walls 14*a* define an internal chamber 24. Each wall 14*a* of the guide member 14 has two horizontal holes 26 which communicate with the internal chamber 24 (see FIGS. 2, 5).

As best shown in FIGS. 3, 4, four complementary die segments 28 are mounted within the internal chamber 24. The die segments 28 have lateral inclined sliding surfaces which define a cilindrical cavity 30, having a longitudinal axis 32, in which moldable material M can be introduced by removing the upper plate 20 from the guide member 14. When the die segments are in the final compression position which is shown in FIG. 4, the volume and the shape of the cavity 30 becomes equal to the volume and the shape of the article to be molded.

Each die segment 28 consists (see FIG. 5) of two separate adjacent segment portions 34 which are superimposed in a direction parallel to the longitudinal axis 32. The segment portions 34 of each die segment 28 are provided with connecting rods 36 which are slidably mounted within the holes 26 of the die segment guide member 14. The connecting rods 26 are connected to the corresponding drive lever 8 at different distances from the pivot axis 8*b*, so that a pivoting movement of the drive lever 8 on the axis 8*b*, which is perpendicular to the longitudinal axis 32, causes different displacements of the segment portions 34.

The radial compression molding apparatus shown in the figures can be utilized for molding an article in form of a cylindrical body (shown with dotted lines in FIG. 5) consisting of two contiguous longitudinal portions 44, 46 which have different diameters. When the die segments 28 are in their first inoperative position (which is shown in FIG. 5) the cavity 30 defined by them has two contiguous longitudinal portions 48, 50 which have different diameters.

The shape of the cavity 30 defined by the segments 28 in their first inoperative position is geometrically similar to the shape of the article to be molded. This means that the ratio between the diameters of the portions 48, 50 is equal to the ratio between the diameters of the portions 44, 46. The lengths of the displacements of the segment portions 34 are such as to accomplish this condition of geometrical similarity.

In the operation of the radial compression die according to the invention, assuming that the die segments 28 are in their first inoperative position shown in FIGS. 3, 5, the moldable material M can be introduced into the cavity 30 defined by the die segments 28 after having temporarily removed the upper plate 20. By means of the control unit 9 fluid can be supplied to the first conduit means 11 for causing the piston rods 6 of the double-acting hydraulic jacks 4 to be moved from their retracted positions towards their elongated positions. Of consequence each drive lever 8 pivots on its pivot axis 8*b* causing a displacement of the segment positions 34 of each the die segment 28. When the piston rods 6 reach their elongated positions, the die segments 28 are in the final compression position shown in FIG. 4, in which they define a cavity having a shape and a volume equal to the shape and the volume of the article to be molded. In this condition, a retracting movement of the piston rods 6 can be obtained by supplying fluid to the second conduit means 13 upon action on the control unit 9. The molded article can then be extracted by the cavity 30 after having removed the upper plate 20.

It is to be understood that a radial compression molding apparatus according to the present invention can be utilized for forming molded articles having any number of contiguous longitudinal portions. It is sufficient that each die segment consists of an equal number of segment portions. Also the cross-section of the molded article can be of any type.

In order to cause the displacements of the segment portions many different driving devices can be used. For example, the segment portions of each die segment could be separately operated by means of a plurality of separate hydraulic jacks.

While the invention has been particularly shown and described with reference to a preferred embodiment thereof, it will be understood by those skilled in the art that various changes in form and details may be made therein without departing from the spirit and scope of the invention.

What I claim is:

1. A radial compression die for forming a molded article by compressing a moldable material from a first volume to a final volume along a plurality of radial directions which are substantially perpendicular to a common longitudinal axis and lie in different planes, said radial compression die comprising a plurality of complementary die segments which define a cavity in which said moldable material is to be introduced and are movable concurrently between a first inoperative position and a final compression position which respectively define said first volume and said final volume, and drive means to forcedly move said die segments between their first and final positions, each of said die segments consisting of a plurality of separate adjacent segment portions which are superimposed along a direction parallel to said common longitudinal axis and are simultaneously operable by said drive means in such a way as to undergo displacements having different lengths when said die segments are moved between their first and final positions.

2. A radial compression die according to claim 1, wherein said drive means comprise a plurality of pivotable drive levers, each drive lever being pivotally connected to a die support member on a pivot axis perpendicular to said common longitudinal axis, the segment portions of each die segment being operatively connected to one of said pivotable drive levers at different distances from the pivot axis of said drive lever whereby a pivoting movement of said drive lever causes different displacements of said segment portions.

* * * * *